US008191967B2

(12) United States Patent
Chen

(10) Patent No.: US 8,191,967 B2
(45) Date of Patent: Jun. 5, 2012

(54) ADJUSTABLE BACK CUSHION STRUCTURE

(75) Inventor: Fu-Chieng Chen, Taipei (TW)

(73) Assignee: Formosa Sounding Corp., Taipei (TW)

( * ) Notice: Subject to any disclaimer, the term of this patent is extended or adjusted under 35 U.S.C. 154(b) by 0 days.

(21) Appl. No.: 12/910,972

(22) Filed: Oct. 25, 2010

(65) Prior Publication Data

US 2011/0095583 A1 Apr. 28, 2011

(30) Foreign Application Priority Data

Oct. 28, 2009 (TW) ..... 98219830 U

(51) Int. Cl.
*A47C 7/02* (2006.01)
*A47C 7/36* (2006.01)

(52) U.S. Cl. ..... 297/230.13; 297/230.14; 297/397; 297/DIG. 6

(58) Field of Classification Search ..... 297/230.13, 297/230.14, 230.1, 352, 397, DIG. 6
See application file for complete search history.

(56) References Cited

U.S. PATENT DOCUMENTS

| | | | | | |
|---|---|---|---|---|---|
| 4,824,169 | A * | 4/1989 | Jarrell | 297/284.1 |
| 4,876,755 | A * | 10/1989 | Parrish | 297/284.3 |
| 5,154,477 | A * | 10/1992 | Lacy | 297/397 |
| 5,310,245 | A * | 5/1994 | Lyszczasz | 297/219.12 |
| 5,533,787 | A * | 7/1996 | Xiang | 297/284.5 |
| 6,086,152 | A * | 7/2000 | Zeller | 297/284.5 |
| 6,807,696 | B2 * | 10/2004 | Magistretti | 5/633 |
| 6,951,367 | B1 * | 10/2005 | Dinnan | 297/228.12 |
| 7,614,691 | B1 * | 11/2009 | Schmitz | 297/219.1 |
| 2010/0148560 | A1 * | 6/2010 | MacPherson | 297/397 |
| 2010/0289305 | A1 * | 11/2010 | Chen | 297/230.13 |

* cited by examiner

*Primary Examiner* — Milton Nelson, Jr.
(74) *Attorney, Agent, or Firm* — Ming Chow; Sinorica, LLC

(57) ABSTRACT

An adjustable back cushion structure comprises an adjusting device, which has three portions, a positioning portion, an adjusting portion and a joining portion, the positioning portion is disposed a block portion thereon, a plurality of fixing portions are disposed between the positioning portion and the adjusting portion, a joining surface is on the top end of the joining portion; and a cushion, which is a member covered by a loop surface, filler is filled into the cushion, any of the surface of the cushion is able to to join the joining surface of the adjusting device.

8 Claims, 10 Drawing Sheets

ADJUSTABLE BACK CUSHION STRUCTURE

BACKGROUND OF THE INVENTION

1. Field of the Invention

The present invention generally relates to an adjustable back cushion structure, more particularly to a back cushion structure that is capable of adjusting best sitting postures according to demands.

2. Description of the Prior Art

Most users who need to sit on chairs of offices or cars for a long time may purchase back cushions for supporting the figures of the vertebras of the waists or backs thereof in order to achieve the purpose of comfort feeling of sitting for a long time.

Such back cushions in the market include a variety. Some are made by that of directly copying the figure of a vertebra, or some have adjusting mechanisms. However, those prior back cushions have following disadvantages:

1. Due to everybody their own unique figure and sitting posture, the effect of a single individual support cannot be achieved if purchasing a back cushion made by that of directly copying the figure of a single vertebra.
2. Although a back cushion with adjusting mechanisms could achieve the effect of adjustment, the weight of the back cushion may be gained since a mechanism should be assembled for the function of adjustment. Hence, the cost is raised to bring out the problem of an expensive product. So, a financial burden may happen to a consumer.

Thus, such prior arts still have some difficulties need to be solved.

The inventor of the present invention has hardly worked on the issue to develop the adjustable back cushion structure of the present invention, and it will be discussed as below.

SUMMARY OF THE INVENTION

The main objective of the present invention is to provide an adjustable back cushion structure. That is, through a positioning portion fixed on a chair or hung from a headrest of the chair and the back cushion combined with a joining portion. The user may adjust and position the back cushion to a suitable position according to the figure of the user's vertebra of the user while sitting on the chair. This provides the user with precise support and the ability for adjustment at any time.

The second objective of the present invention is to provide the adjustable back cushion structure. That is, the adjustable back cushion structure is a simple structure. Furthermore, the structure is easily operated and manufactured with low cost.

To achieve above objectives of the adjustable back cushion structure, the adjustable back cushion structure comprises an adjusting device and a cushion. The adjusting device comprises a positioning portion, an adjusting portion and a joining portion. The positioning portion is disposed on a block portion. The block portion can be embedded into a narrow opening between a back and a seat of a chair. The lateral side of the positioning portion is joined with the adjusting portion. A plurality of fixing portions is disposed between the positioning portion and the adjusting portion. Finally, another side of the adjusting portion is joined with the to joining portion. A joining surface is on the top end of the joining portion for joining and positioning the cushion. Based on the above construction of the components, the cushion on the joining portion can be adjusted to a suitable position according to different support demands prior to a user sits on the chair, and the purposes of supporting precisely and adjusting at any time are achieved while sitting on the chair.

Other and further features, advantages, and benefits of the invention will become apparent in the following description taken in conjunction with the following drawings. It is to be understood that the foregoing general description and following detailed description are exemplary and explanatory but are not to be restrictive of the invention. The accompanying drawings are incorporated in and constitute a part of this application and, together with the description, serve to explain the principles of the invention in general terms. Like numerals refer to like parts throughout the disclosure.

BRIEF DESCRIPTION OF THE DRAWINGS

The objects, spirits, and advantages of the preferred embodiments of the present invention will be readily understood by the accompanying drawings and detailed descriptions, wherein.

DETAILED DESCRIPTION OF THE INVENTION

Following preferred embodiments and figures will be described in detail so as to achieve aforesaid objects.

Figure 1:
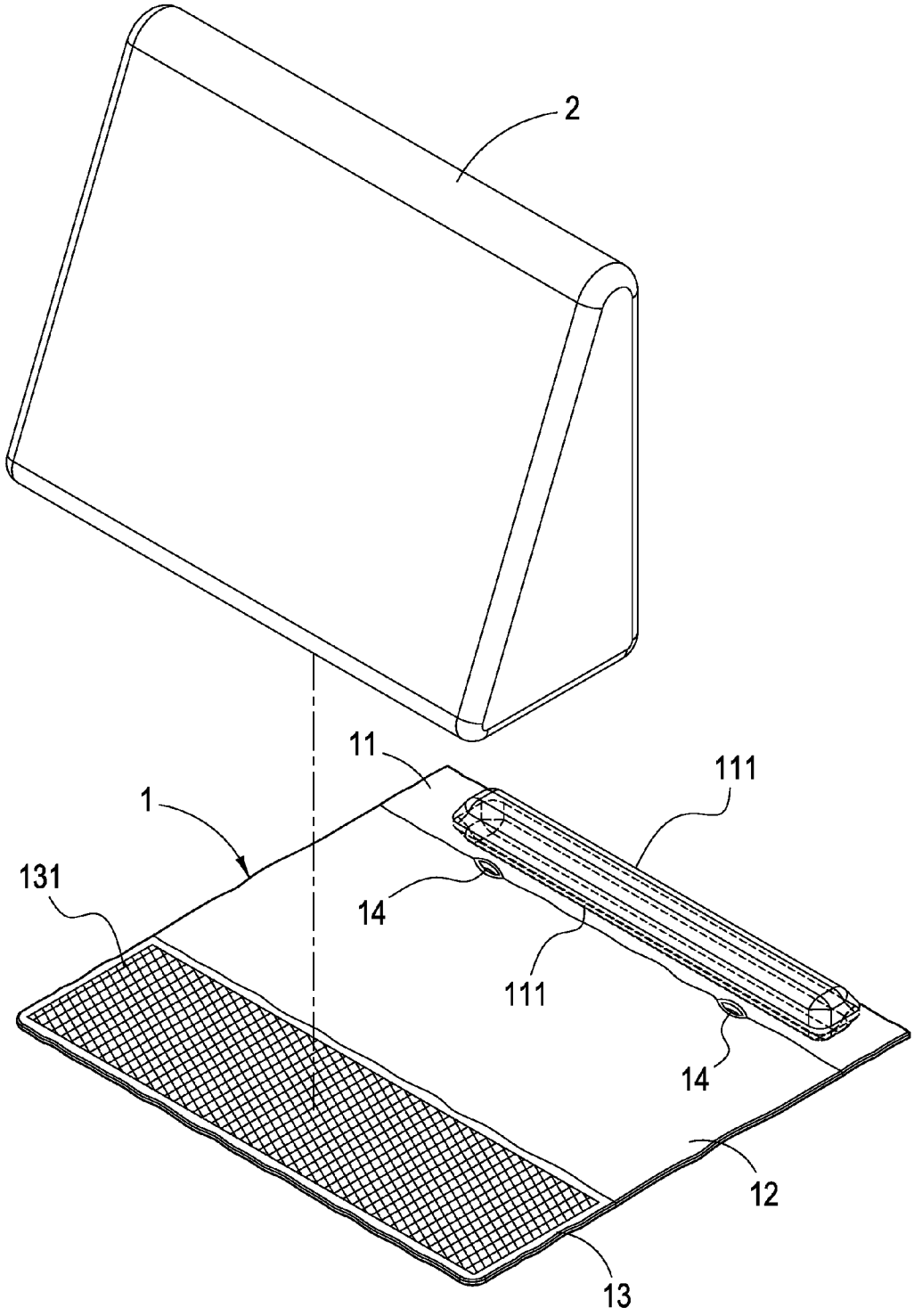
FIG. 1 illustrates a schematic exploded view of the adjustable back cushion structure of the present invention.
Figure 2:
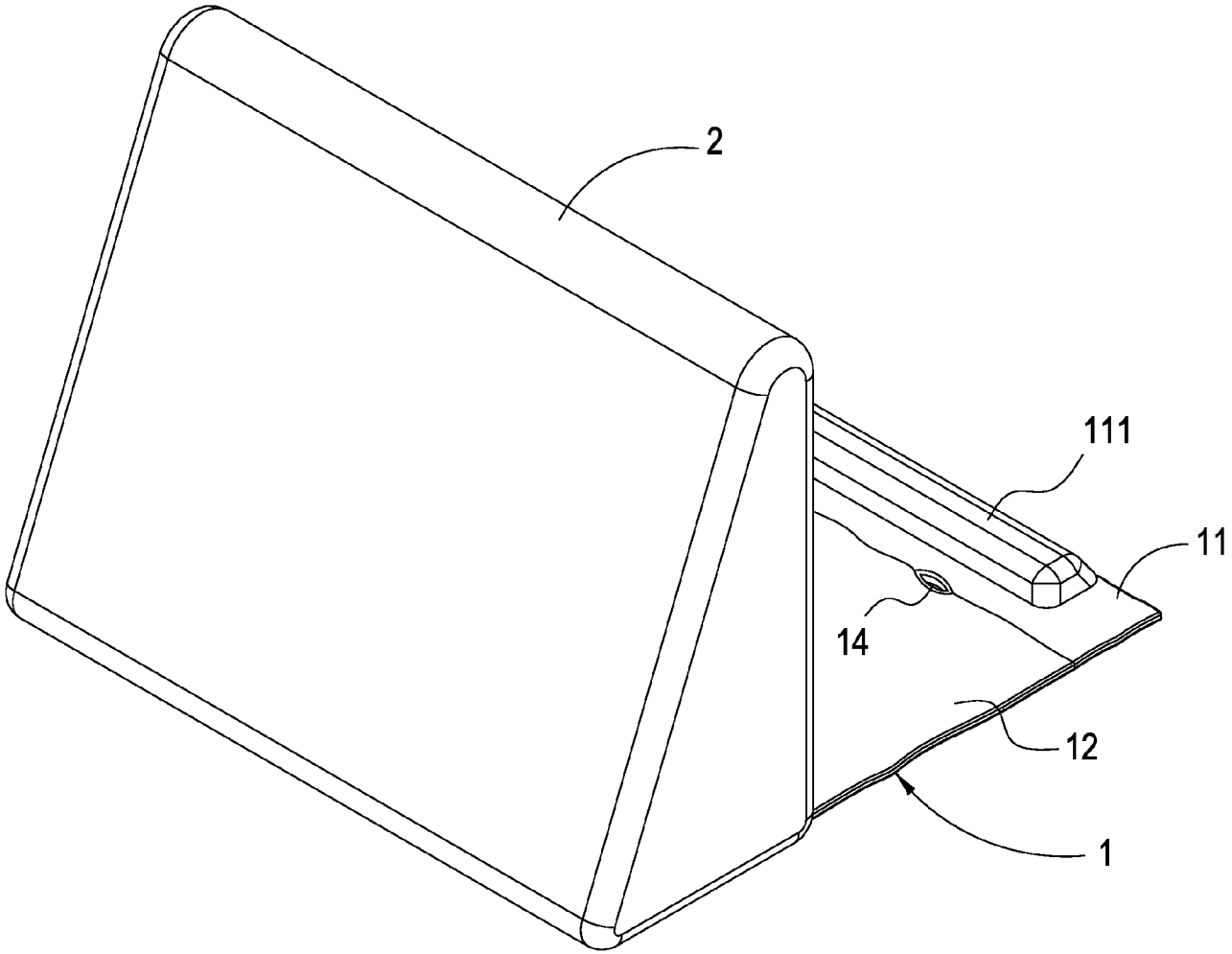
FIG. 2 illustrates a schematic combined view of the adjustable back cushion structure of the present invention.

With references to FIG. 1 and FIG. 2, which illustrate a schematic exploded view of the adjustable back cushion structure of the present invention and a schematic combined view of the to adjustable back cushion structure of the present invention. The adjustable back cushion structure includes:

an adjusting device 1, which has three portions of a positioning portion 11, an adjusting portion 12 and a joining portion 13, the block portion 111 is disposed on the positioning portion 11, the adjusting portion 12 is on the lateral side of the positioning portion 11, a plurality of fixing portions 14 are disposed between the positioning portion 11 and the adjusting portion 12, the joining portion 13 is on the lateral side of the adjusting portion 12, a joining surface 131 is on the top end of the joining portion 13, the fixing portion 14 is a hole, the joining surface 131 of the joining portion 13 is a hook-and-loop fastener surface;

a cushion 2 is a member covered by a loop surface. Filler is filled into the cushion 2. Any surface of the cushion 2 is able to join to the joining surface 131 of the adjusting device 1. The filler for the cushion 2 is one of the materials of soft rubber foam, soft plastic foam and elastic silicon polymer gel and has the characteristic of buffering;

wherein the joining surface 131 of the adjusting device 1 can be a hook-and-loops surface as well, the surface of the cushion 2 is a corresponding hook-and-loops surface, so that the cushion 2 and the joining surface 131 of the adjusting device 1 can be fastened together.

Figure 3:
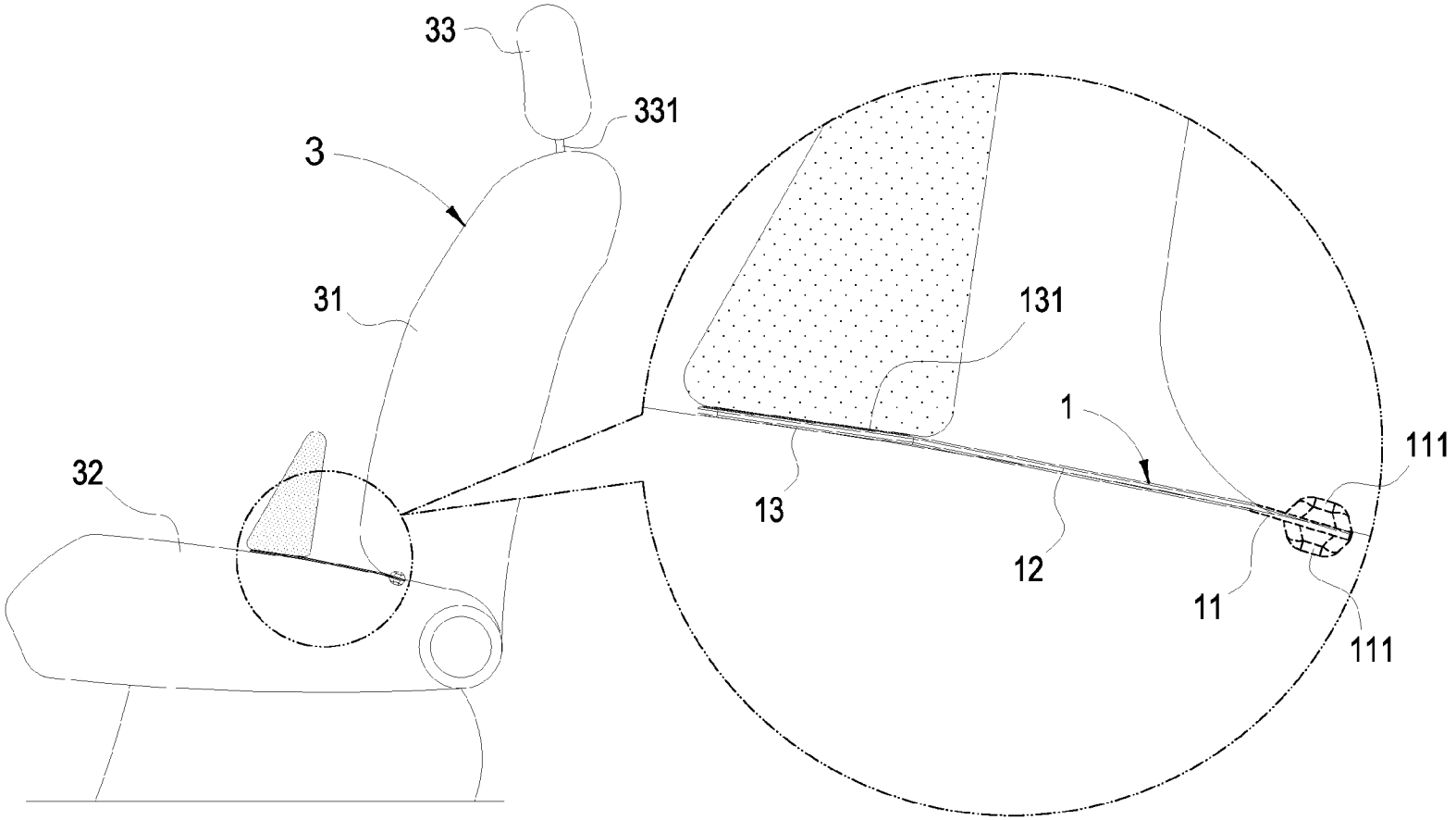
FIG. 3 illustrates a schematic lateral combined view of the adjustable back cushion structure of the present invention.
Figure 4:
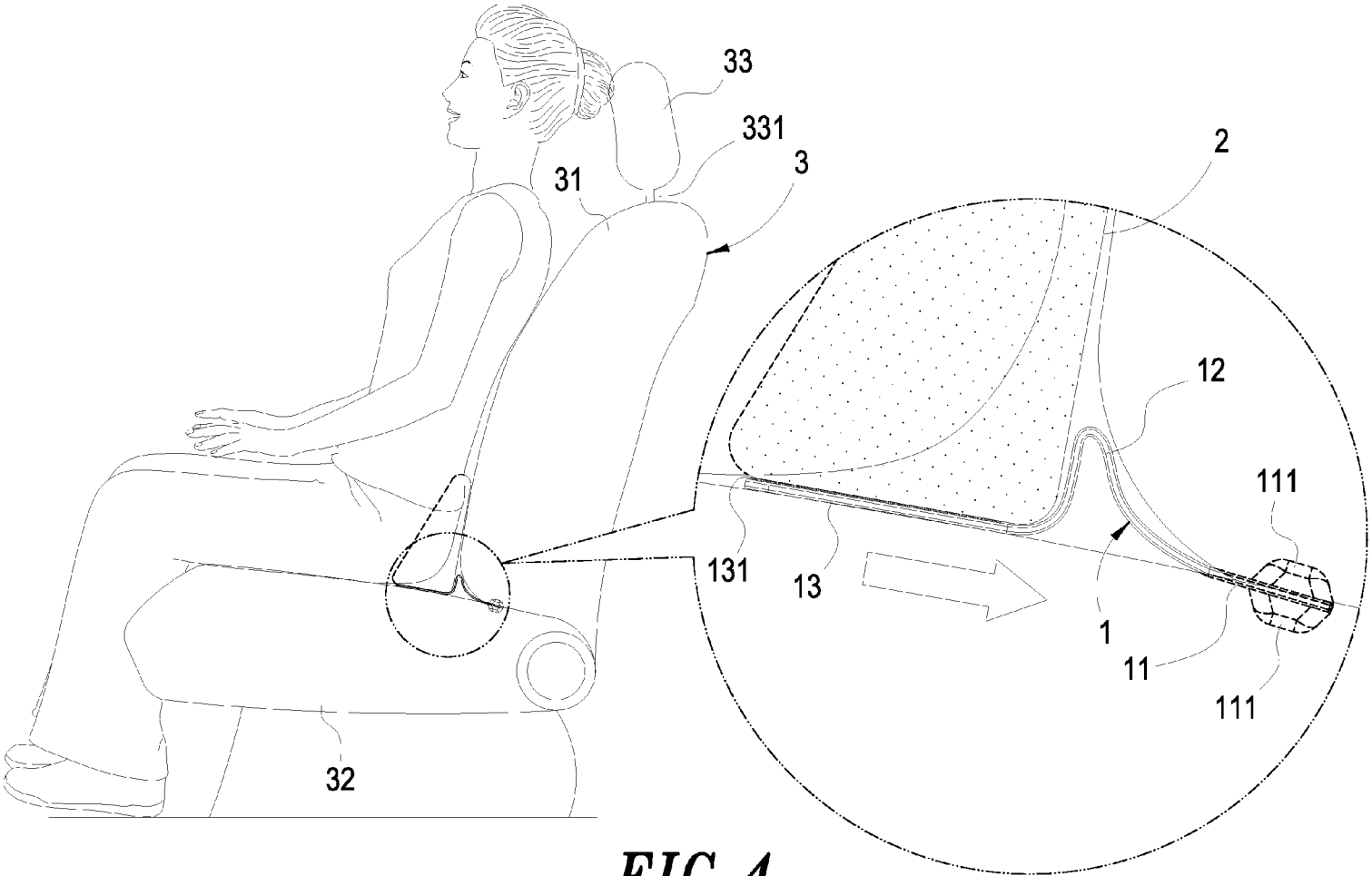
FIG. 4 illustrates a schematic lateral adjusting view of a user's waist of the adjustable back cushion structure of the present invention.
Figure 5:
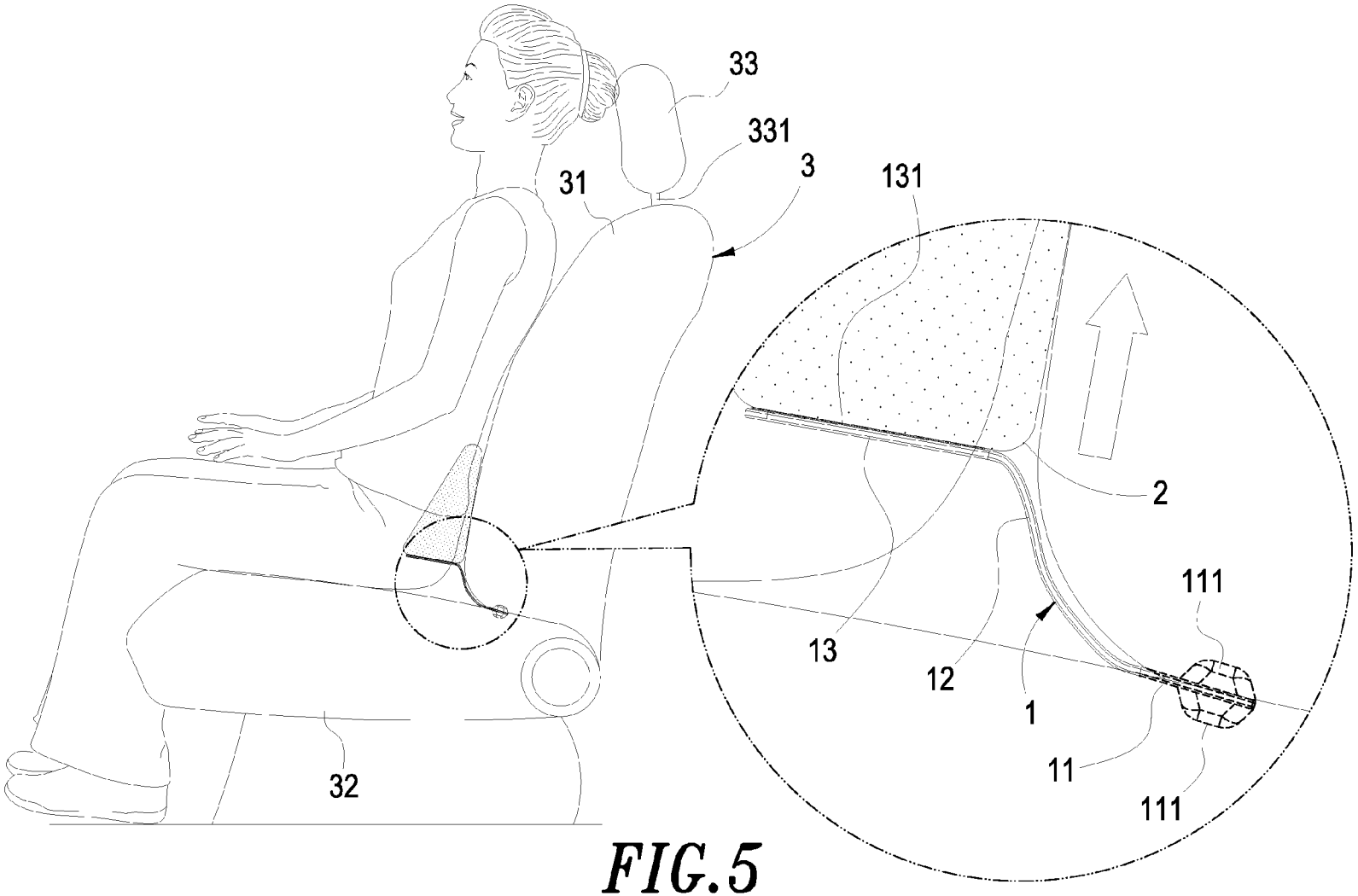
FIG. 5 illustrates another schematic lateral adjusting view of the user's waist of the adjustable back cushion structure of the present invention.

With references to FIG. 3, FIG. 4 and FIG. 5, which illustrate a schematic lateral combined view of the adjustable back cushion structure of the present invention, a schematic lateral adjusting view of a user's waist of the adjustable back cushion structure of the present invention and another schematic lateral adjusting view of a user's waist of the adjustable back cushion structure of the present invention. That is, the block portion 111 of the positioning portion 11 of the adjusting device 1 is embedded into a narrow opening between a back 31 and a seat 32 of a chair 3. Prior to a user sitting on the chair 3, the adjusting device 1 with the cushion 2 can be moved forward and backward or up and down for adjusting the positions of the cushion 2 through the adjusting portion 12, as shown in FIG. 4 and FIG. 5. While the cushion 2 is moved to the most suitable position, the waist of the user is approaching to a best support while sitting on the chair 3.

Figure 6:
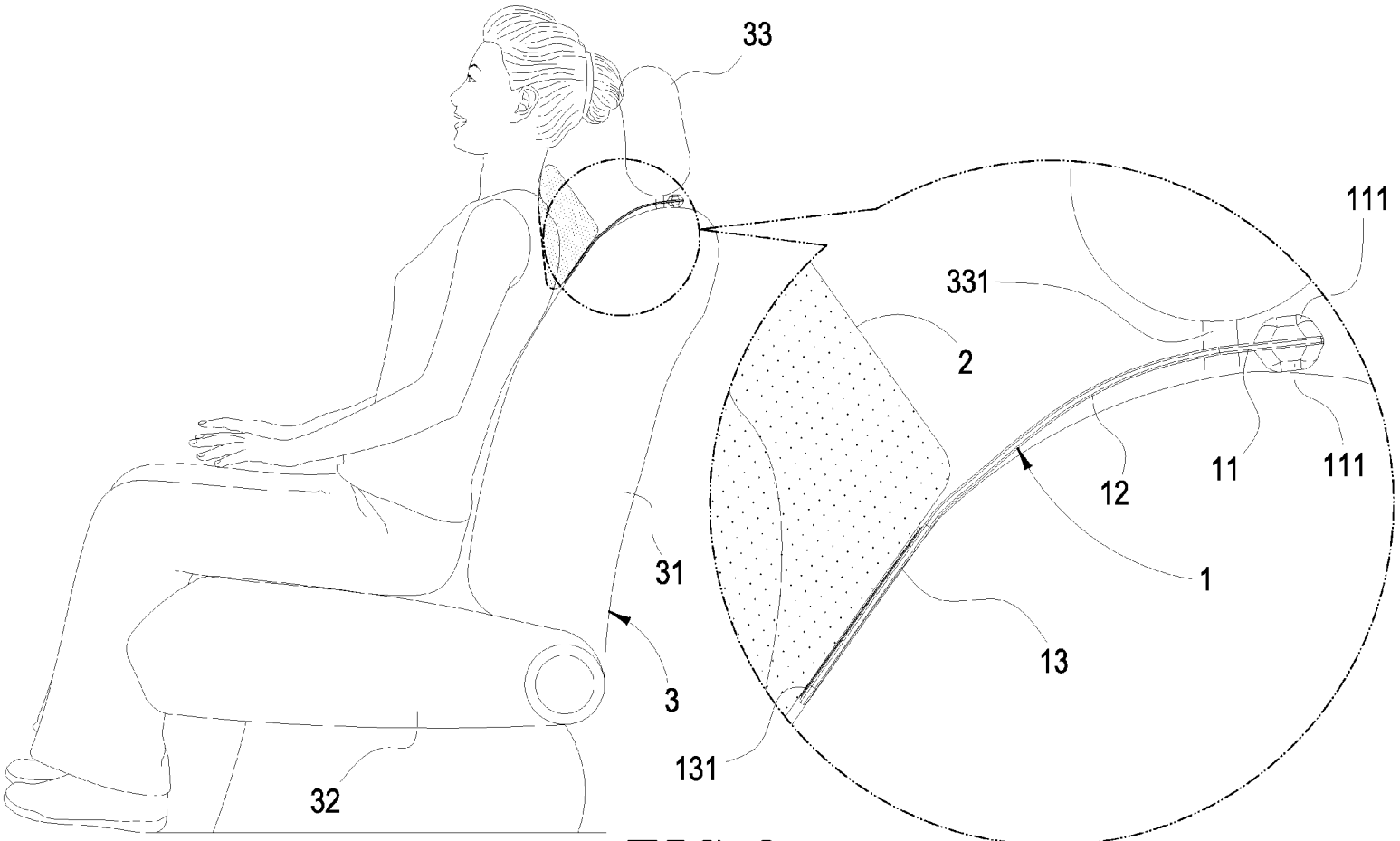
FIG. 6 illustrates a schematic lateral adjusting view of a user's neck of the adjustable back cushion structure of the present invention.

With reference to FIG. 6, which illustrates a schematic lateral adjusting view of a user's neck of the adjustable back cushion structure of the present invention. That is, the plurality of fixing portions 14 of the adjusting device 1 encloses a plurality of adjusting mechanism 331 of a headrest 33 of the chair 3 so as to let the neck of the user be best supported by the cushion 2.

Figure 7:
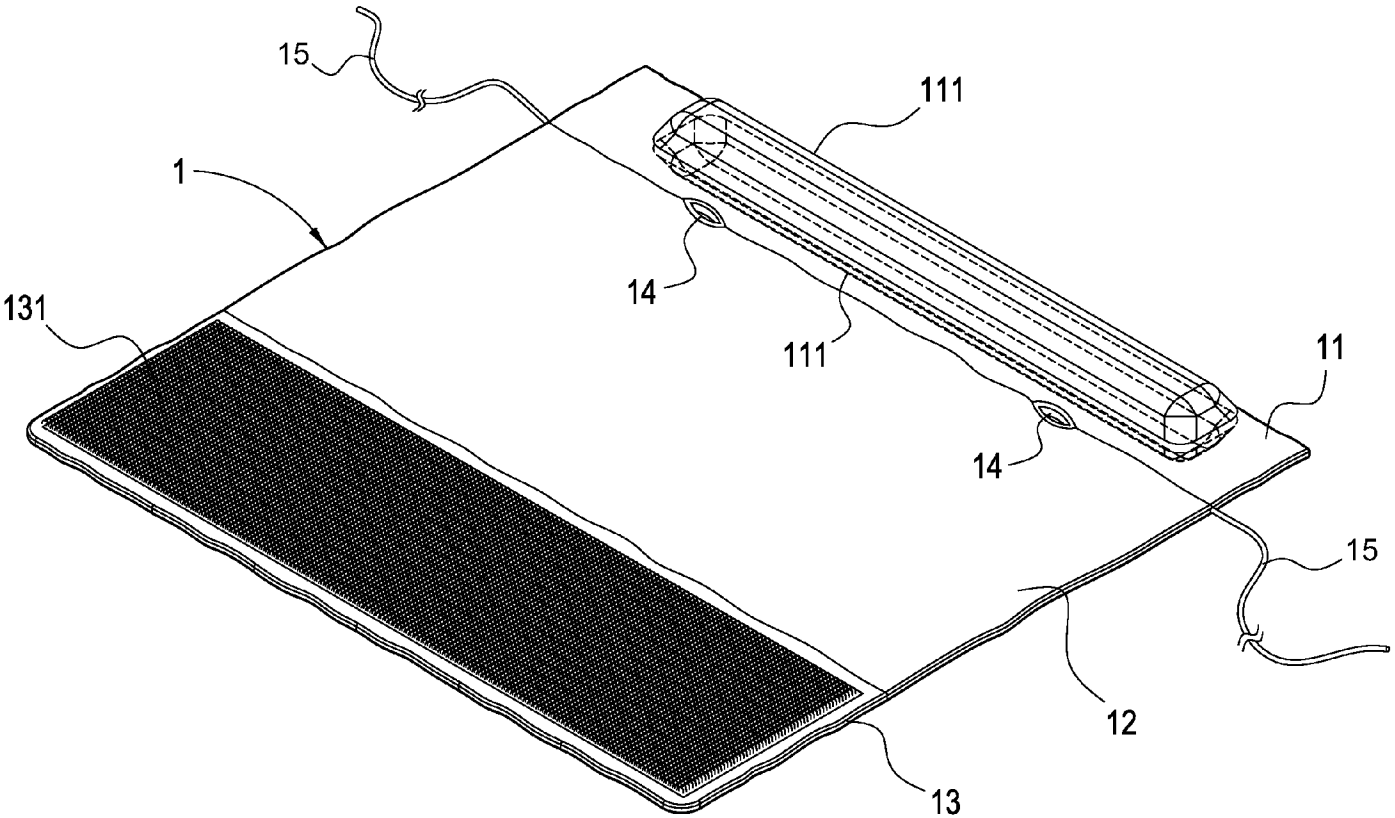
FIG. 7 illustrates a schematic view of another embodiment of the adjustable back cushion structure of the present invention.
Figure 8:
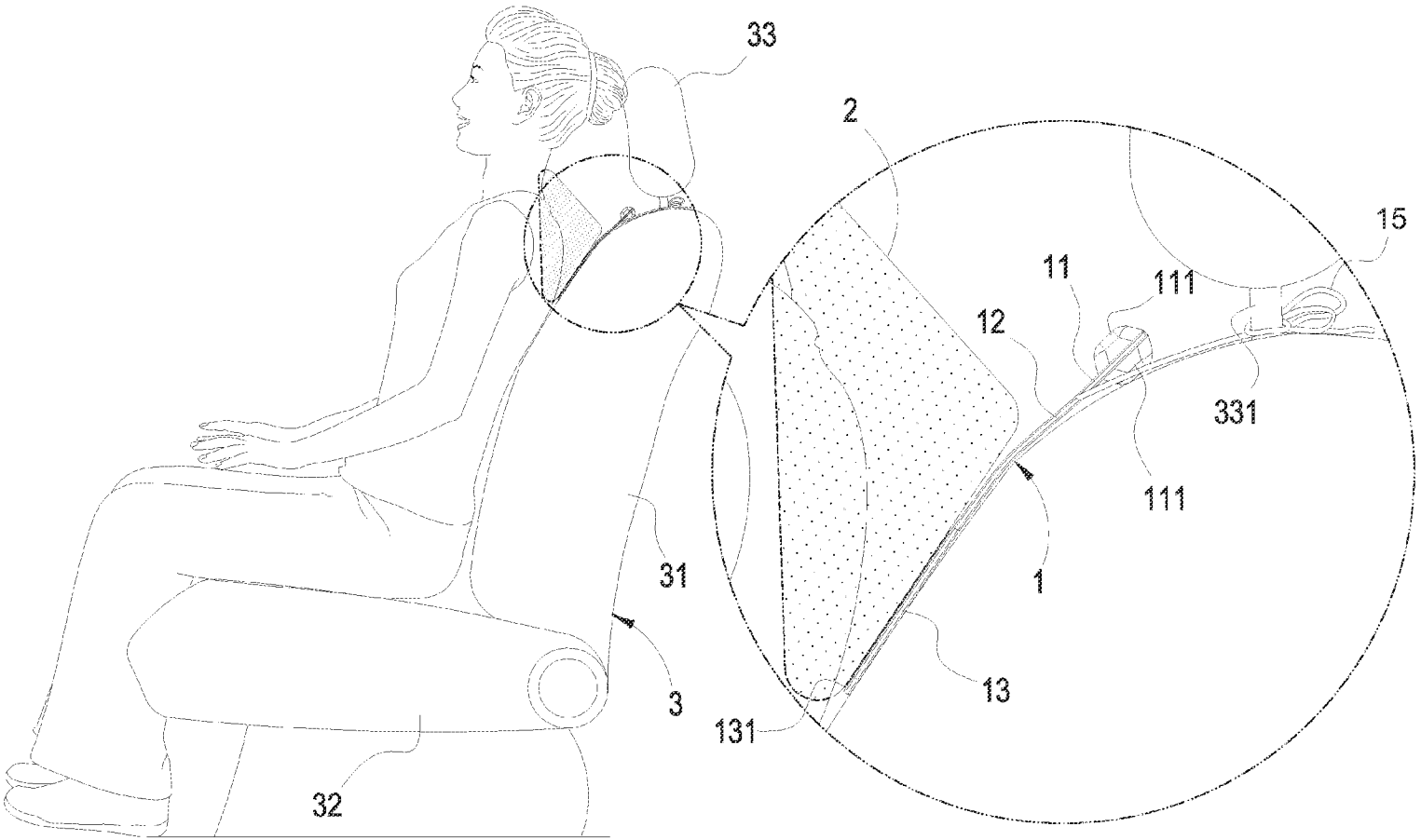
FIG. 8 illustrates a schedule application view of the embodiment of the adjustable back cushion structure of the present invention.

With references to FIG. 7 and FIG. 8, which illustrate a schematic view of another embodiment of the adjustable back cushion structure of the present invention and a schedule application view of the embodiment of the adjustable back cushion structure of the present invention. The whole structure of the embodiment is mostly the same as the structure in FIG. 1. The difference is that the fixing portions 14, disposed between the positioning portion 11 and the adjusting portion 12, are ropes. Other parts are the same and may not be described any further hereinafter. Through binding the two ropes 15 to the adjusting mechanism 331 of the headrest 33 of the chair 3, the embodiment approaches the purpose of the user's neck being best supported.

Figure 9:
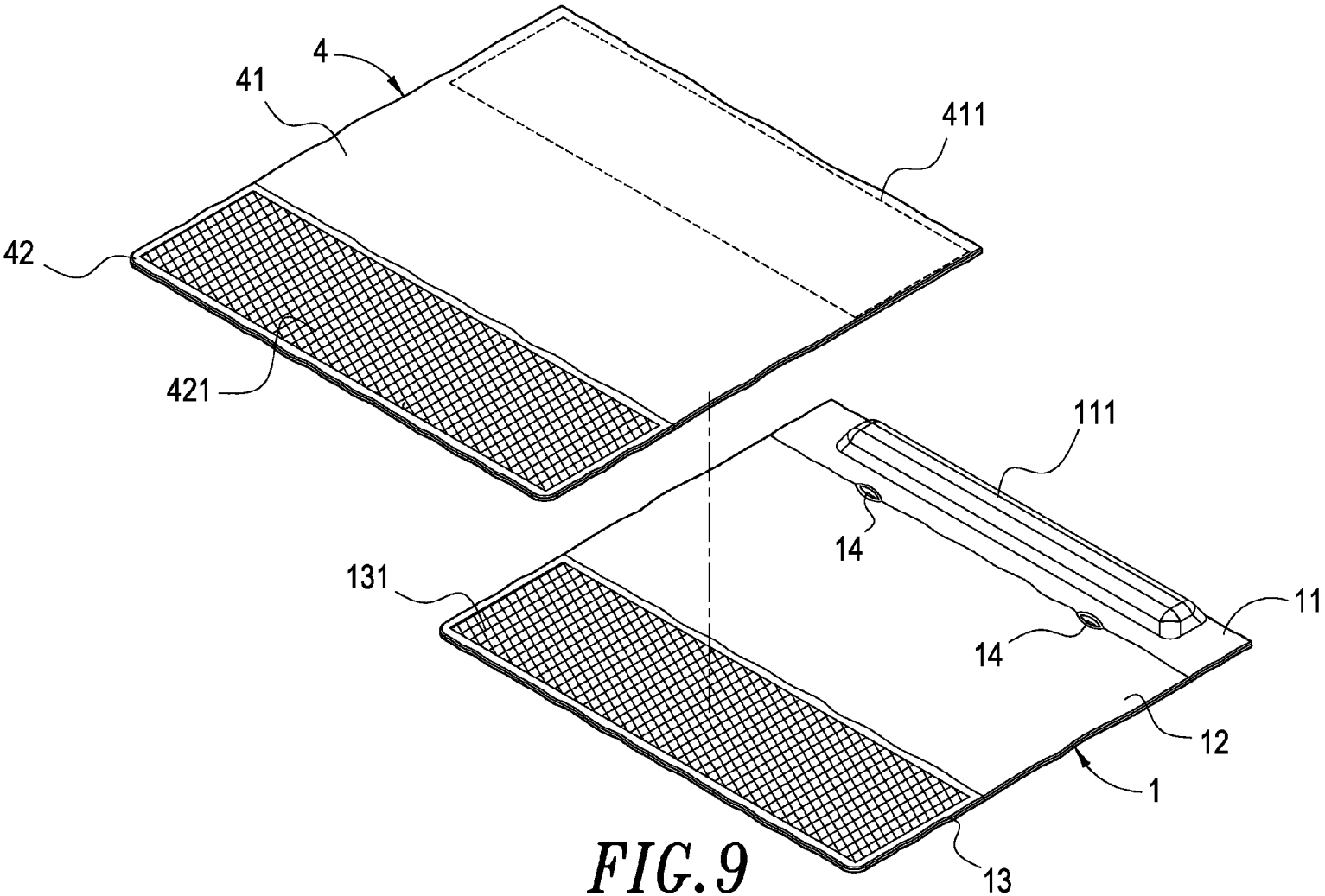
FIG. 9 illustrates a schematic view of a third embodiment of the adjustable back cushion structure of the present invention and FIG. 10 illustrates a schematic application view of the third embodiment of the adjustable back cushion structure of the present invention.
Figure 10:
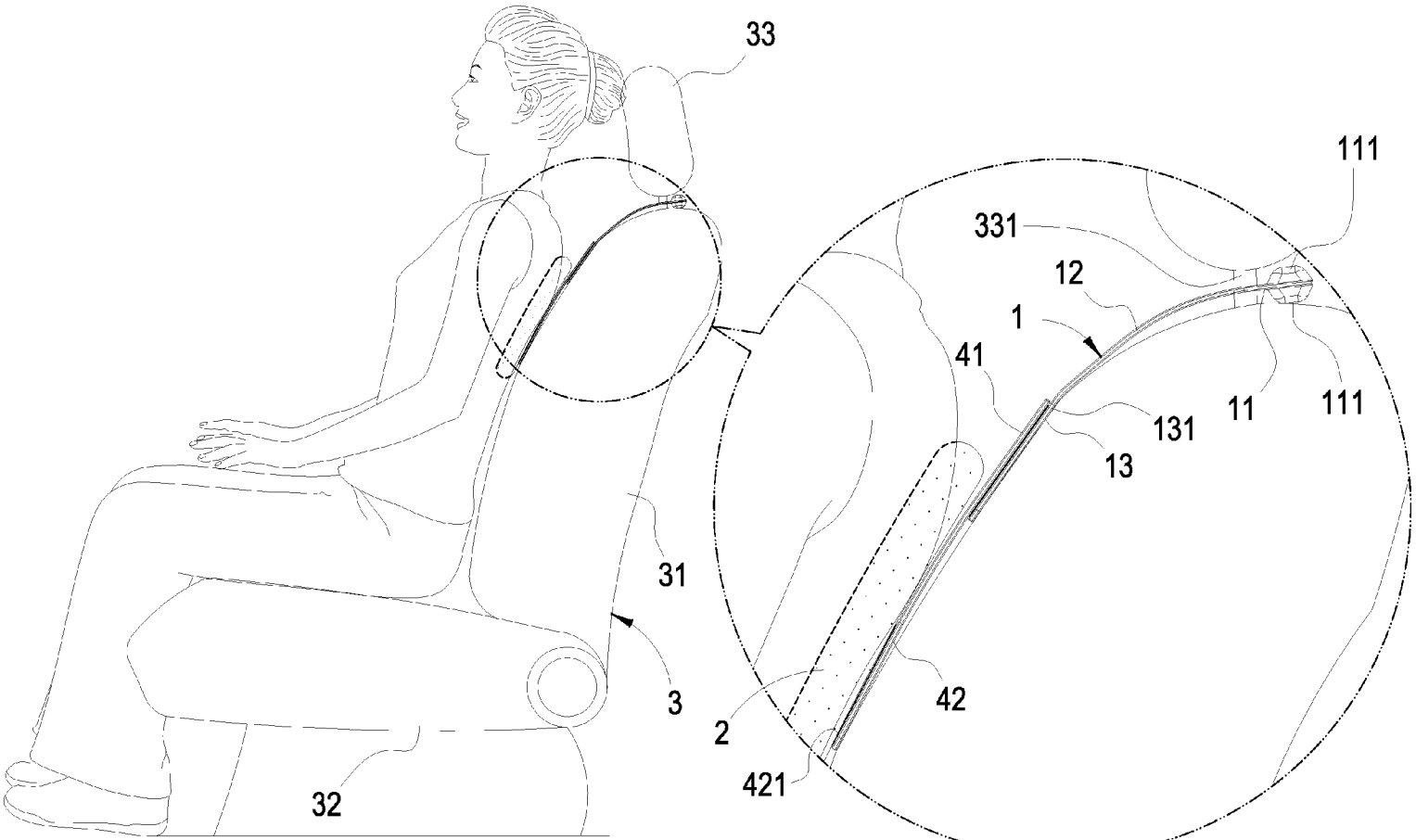

With references to FIG. 9 and FIG. 10, which illustrate a schematic view of a third embodiment of the adjustable back cushion structure of the present invention and a schematic application view of the third embodiment of the adjustable back cushion structure of the present invention. The third embodiment adopts that of the back cushion 1 being additionally connected with an extending piece 4. The extending piece 4 has an adjusting portion 41, a lateral end surface of the adjusting portion 41 has a connecting surface 411, another lateral end surface of the adjusting portion 41 is a joining portion 42, a joining surface 421 is disposed on a top end surface of the joining portion 42, the connecting surface 411 and the joining surface 421 are not on the same surface, the extending piece 4 is integrated with the joining surface 131 of the adjusting device 1 via the connecting surface 411, the connecting surface 411 of the adjusting portion 41 is a hook-and-loops fastener surface, the joining surface 421 of the joining portion 42 is a corresponding hook-and-loops fastener surface. Hence, by means of the connecting surface 411 of the extending piece 4 connecting with the joining surface 131 of the adjusting device 1, the length of the adjusting device 1 is elongated. Furthermore, by combining the cushion 2 to the joining surface 421 of the extending piece 4 to support the back of the user so as to approach the purpose of the best support of the to back.

To compare the adjustable back cushion structure of the present invention with other prior arts, the present invention has the advantages as below:

1. Through the positioning portion being fixed on the chair or hung from the headrest of the chair and the back cushion combined with the joining portion, the user may adjust and position the back cushion to a suitable position according to the figure of the vertebra of the user while sitting on the chair, so that the purposes of supporting precisely and adjusting at any time are achieved.
2. The present invention provides the adjustable back cushion structure that is a simple structure, further, the structure is easily operated and manufactured with low cost.

Although the invention has been disclosed and illustrated with reference to particular embodiments, the principles involved are susceptible for use in numerous other embodiments that will be apparent to persons skilled in the art. This invention is, therefore, to be limited only as indicated by the scope of the appended claims.

What is claimed is:

1. An adjustable back cushion structure comprising:
an adjusting device, which has three portions, a positioning portion, an adjusting portion and a joining portion;
the positioning portion being disposed on a block portion;
a plurality of fixing portions being disposed between the positioning portion and the adjusting portion;
a joining surface being on a top end of the joining portion; and
a cushion, which is a member covered by a loop surface, filler being filled into the cushion, any part or part of the surface of the cushion being able to join the joining surface of the adjusting device.

2. The adjustable back cushion structure according to claim 1, wherein the joining surface of the joining portion is a hook surface of a hook-and-loops fastener.

3. The adjustable back cushion structure according to claim 1, wherein the fixing portion is a hole.

4. The adjustable back cushion structure according to claim 1, wherein the fixing portion is a rope.

5. An adjustable back cushion structure comprising:
an adjusting device, which has three portions, a positioning portion, an adjusting portion and a joining portion;
the positioning portion being disposed on a block portion;
a plurality of fixing portions being disposed between the positioning portion and the adjusting portion;
a joining surface being on a top end of the joining portion;
an extending piece, which has an adjusting portion, a lateral end surface of the adjusting portion having a connecting surface;
another lateral end surface of the adjusting portion being a joining portion;
a joining surface being disposed on the joining portion;
the extending piece being integrated with the joining surface of the adjusting device via the connecting surface; and
a cushion, which is a member covered by a loop surface, filler being filled into the cushion, any of the surface of the cushion being able to join the joining surface of the extending piece.

6. The adjustable back cushion structure according to claim 5, wherein the fixing portion is a rope.

7. The adjustable back cushion structure according to claim 5, wherein the connecting surface and the joining surface are disposed on the different surfaces of the extending piece.

8. The adjustable back cushion structure according to claim 5, wherein the fixing portion is a hole.

* * * * *